United States Patent [19]

Clausen

[11] 4,277,049

[45] Jul. 7, 1981

[54] LIFT STRUCTURE FOR SERVICING VEHICLES

[76] Inventor: Donald A. Clausen, 815 W. 34th St., Minneapolis, Minn. 55408

[21] Appl. No.: 151,257

[22] Filed: May 19, 1980

[51] Int. Cl.[3] ..... B66F 7/02

[52] U.S. Cl. ..... 254/91

[58] Field of Search ..... 414/917, 678; 254/4 C, 254/10 C, 90, 91

[56] References Cited

U.S. PATENT DOCUMENTS

| | | | |
|---|---|---|---|
| 2,117,652 | 1/1964 | Wallace . | |
| 2,624,546 | 1/1953 | Haumerson . | |
| 2,640,562 | 6/1953 | Villars . | |
| 2,934,220 | 4/1960 | Murphy | 254/10 C X |
| 4,022,428 | 5/1977 | Mantha . | |
| 4,158,524 | 6/1979 | Serafin | 254/10 C X |

FOREIGN PATENT DOCUMENTS

| | | | |
|---|---|---|---|
| 481457 | 12/1953 | Italy | 254/91 |

*Primary Examiner*—Robert C. Watson
*Attorney, Agent, or Firm*—Leo Gregory

[57] ABSTRACT

A lifting structure for use in connection with relatively small vehicles such as turf or sod cutting tractors or garden tractors to elevate the same into a raised position for the purpose of servicing the vehicles, the structure consisting of a base frame having pivoted thereto by elevating leg members a supporting frame having thereon a pair of adjustably spaced vehicle supporting cross members, an upstanding frame member at one end of the base member carrying a winch being removably connected by a cable to the vehicle supporting frame to raise the elevating leg members into a locked vertical position and the elevating leg members are adapted to position the vehicle supporting frame at a plurality of heights.

2 Claims, 6 Drawing Figures

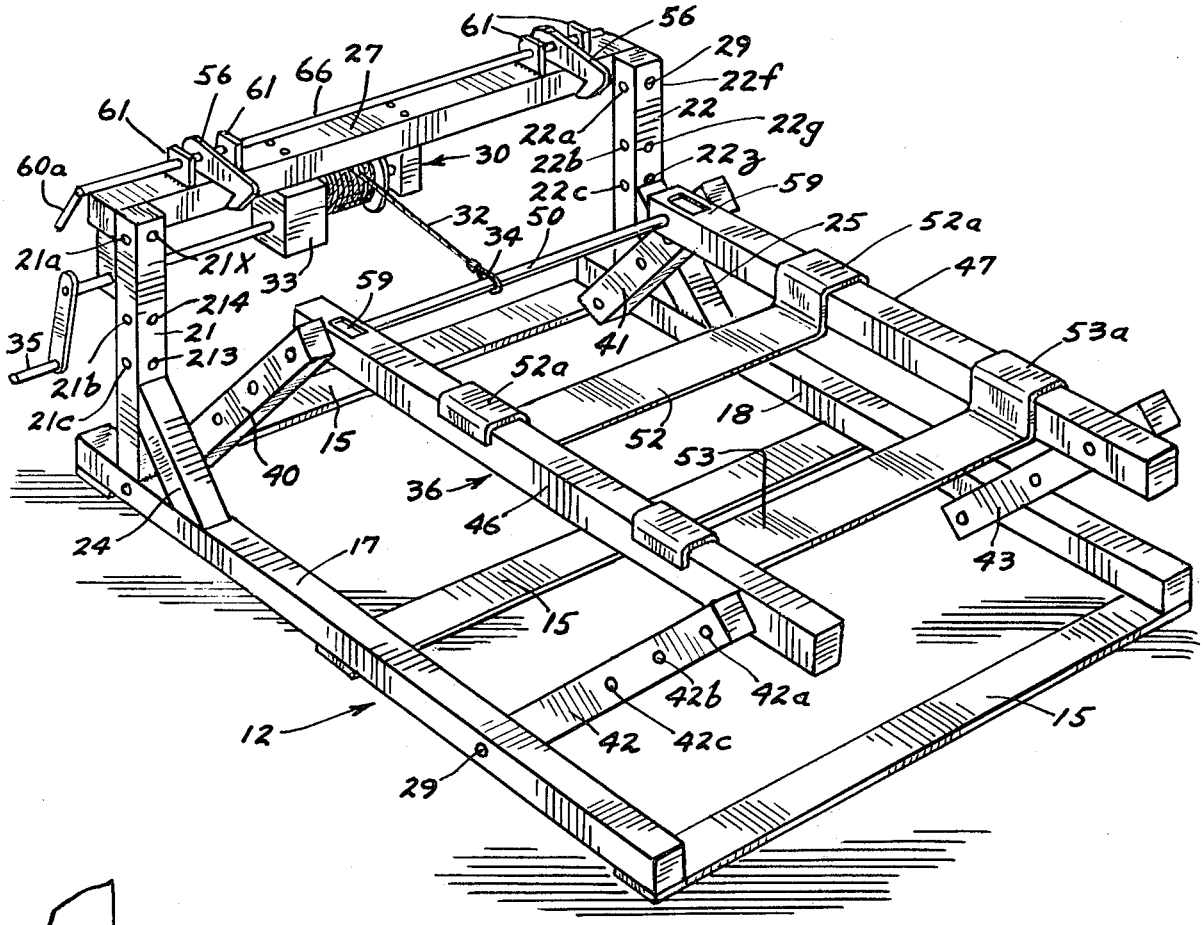
FIG. 1
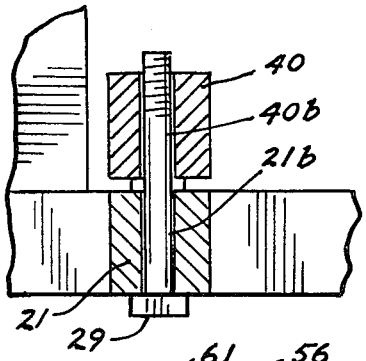
FIG. 3
FIG. 2
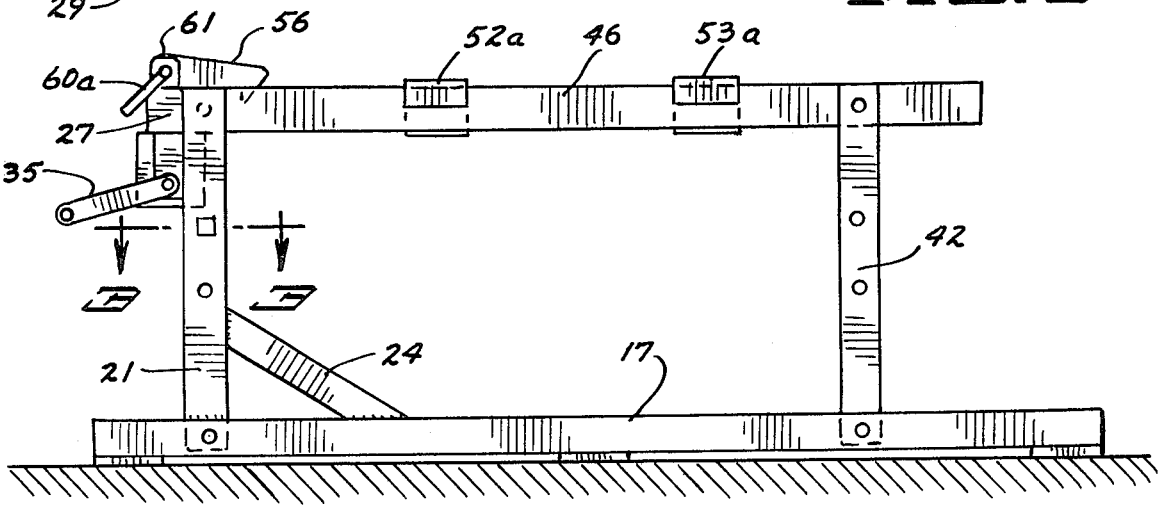

LIFT STRUCTURE FOR SERVICING VEHICLES

BACKGROUND OF THE INVENTION

1. Field of the Invention

This invention relates to a lift mechanism for servicing small vehicles.

2. Description of the Prior Art

Commonly known in the prior art are hoist members for servicing vehicles such as are elevated by a single or a plurality of hydraulic shafts.

Also known in the art for elevating vehicles are supporting frame members in connection with vertical post members equipped with a cable lift at each post and a manual or a motor driven crank for vertically raising the supporting member with the vehicle to be serviced thereon.

Hoist structures generally in use are adapted for use with substantially larger vehicles than those herein indicated and are neither convenient nor economical for use with relatively small vehicles.

SUMMARY OF THE INVENTION

The invention herein relates to a substantially simplified elevating structure particularly adapted for use in connection with relatively small vehicles such as turf or sod cutting tractors and garden tractors whereby they may be suitably raised to be serviced.

It is desirable to have a vehicle lift mechanism which requires the use of but a single relatively short cable operated by a small winch to elevate the structure.

It is further desirable to provide an elevating structure having a base frame connected by elevating pivoted members to a vehicle supporting frame member, an upstanding frame member at one end of said base member having a winch removably connected by a cable to said vehicle supporting frame member to raise said frame member by said elevating pivoted members from a substantially ground level position to an elevated operating or servicing position and having means to lock said supporting frame member into said elevated position.

These and other objects and advantages of the invention will be set forth in the following description made in connection with the accompanying drawings in which like reference characters refer to similar parts throughout the several view.

DESCRIPTION OF THE DRAWINGS

FIG. 1 is a view in perspective;

FIG. 2 is a view in side elevation with the structure in raised position;

FIG. 3 is a fragmentary view in horizontal section taken as line 3—3 of FIG. 2;

DESCRIPTION OF PREFERRED EMBODIMENT

Figure 4:
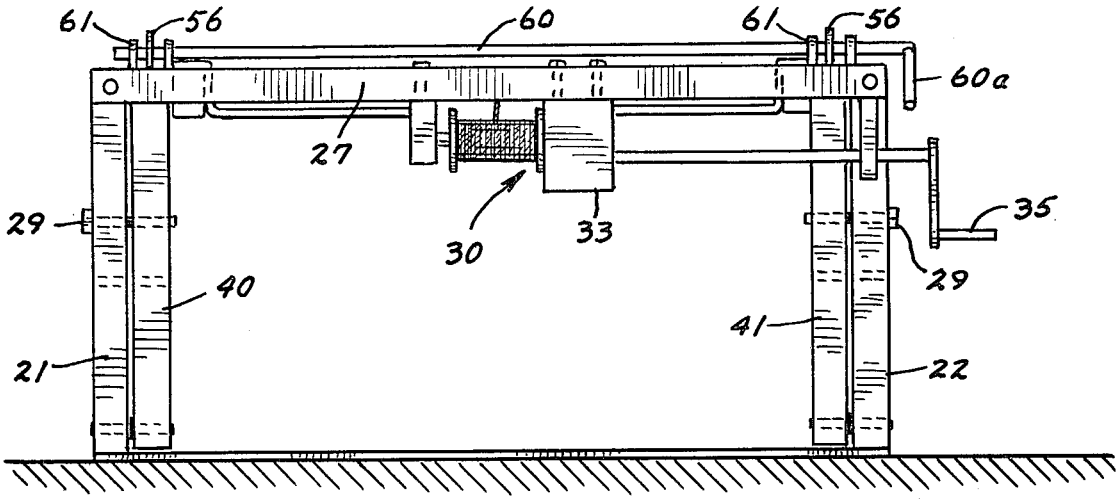
FIG. 4 is a view in end elevation.
Figure 5:
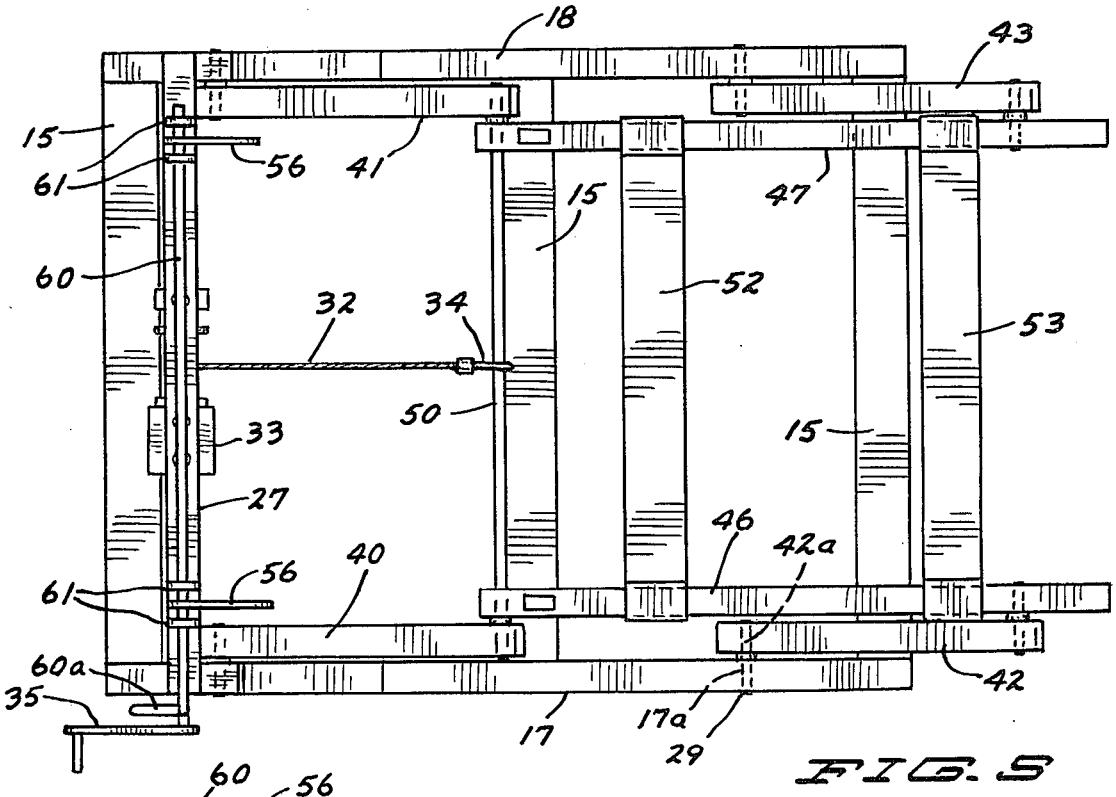
FIG. 5 is a top plan view.
Figure 6:
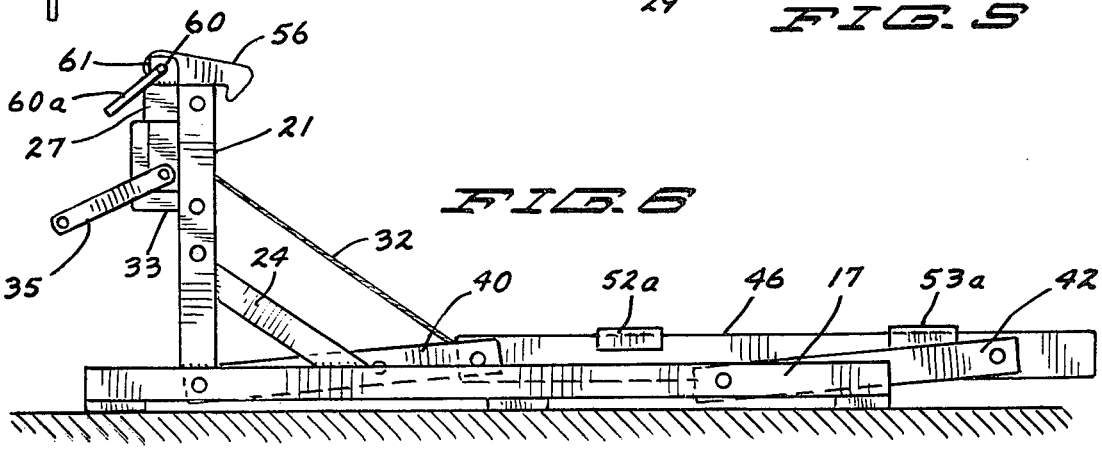
FIG. 6 is a view in side elevation with the structure in lowered position.

Referring to the drawings, the structure comprising the invention herein is indicated generally by the reference numeral 10.

Said structure 10 comprises a base frame 12 which is shown consisting of spaced cross members 15 supporting two transversely spaced longitudinal side members 17 and 18 secured to said cross members as by welding.

Upstanding from said side members adjacent one end of said base frame member are vertical frame members 21 and 22 braced by the angle members 24 and 25 as shown.

A horizontal frame member 27 extends across and rearwardly of the members 21 and 22 being removably secured to the upper end portions thereof by bolts 29 extending through the holes 21*x* and 22*x*. For positioning said member 27 at lower levels, the holes 21*y*, 21*z* and the holes 22*y*, 22*z* respectively are provided extending through said members 21 and 22. At right angles through said members 21 and 22 respectively aligned with said holes 21*x–z* and 22*x–z* are holes 21*a–c* and 22*a–c*.

Carried by said member 27 centrally thereof is a winch apparatus 30 of conventional design which is suitably secured and includes a cable 32, a gear reduction box 33 and a crank 35.

Next will be described the vehicle elevating means or structure which is indicated generally by the reference numeral 36.

Transversely aligned longitudinally spaced pairs of elevating frame leg members 40, 41 and 42, 43 are pivoted to said side members 17 and 18 as by bolts 29 through accommodating aligned holes such as at 17*a* and 42*a*. Each of said members is provided with holes at the same vertical levels as the holes 21*a–c* and representative of said holes are the holes 42*a*–42*c* of the elevating member 42.

Removably and pivotally secured to said members 40, 42 and 41, 43 are the transversely spaced longitudinally extending supporting members 46 and 47. Said members have a bar or shaft 50 extending therebetween and suitably secured thereto at their rearward ends adjacent to member 27. Said cable is removably attached to said shaft 50 by means of hook 34. Said longitudinal members 46 and 47 may be pivoted to said elevating members 40–43 at various heights thereof by means of the vertically spaced holes of said elevating members corresponding to those indicated at 42*a–c*.

Supported upon said members 46 and 47 are movable supporting plate members 52 and 53 having reversely angled or hook shaped end portions 52*a* and 53*a* to seat over and rest upon said members 46 and 47.

Carried by said bar or frame member 27 adjacent each upper end portion thereof are latching or hook members 56 adapted to engage keepers 59 formed as recesses in the adjacent ends of the members 46 and 48 that when said members are elevated into operating position as will be described hereinafter, they shall be automatically locked into position.

Extending through said latch members to be rigid therewith is a bar or rod 60 having an angled end portion 60*a* forming a crank to elevate said hook members to unlatch the same as will be further described. Said rod is held in position on said member 27 by bearing plate keepers 61.

When the members 40 and 41 are in vertical position aligned with the members 21 and 22, a bolt 29 will be disposed through pairs of aligned holes such as 21*b*, 40*b*, (as shown in FIG. 3) and 22*b*, 41*b* to securely lock said members 40 and 42 in operating position.

OPERATION

In standing ready for use, the vehicle supporting means 36 will be at rest upon the base structure 12. The plate members 52 and 53 will be spaced apart to support the bottom of the chassis of the vehicle to be serviced.

With the cable 32 attached to the shaft or bar 50, the winch by means of the crank 35 will be operated to pivot or swing the members 40–43 into vertical position.

As the rearward ends of the members 46 and 48 abut said cross member and engage and raise the hook members 56, said hook members will automatically fall into the keepers or recesses 59.

Bolts 29 will be disposed through aligned pairs of holes of the members 21, 40 and 22, 41 to securely lock the supporting structure 36 in its raised vehicle servicing position. In raised operating position the elevating members 40 and 41 will be in vertical alignment with said members 21 and 22 at their respective inner sides.

In the event that better access is desired to reach the vehicle to be serviced, the frame member 27 is readily removed by removal of its attaching bolts 29. The cable hook 34 is then detached from the rod or shaft 50.

By reversing the operation described, the vehicle being serviced is readily lowered to ground level.

The apparatus herein is of simple construction, the operation is positive and the elevating or supporting structure is securely locked in its elevated servicing position.

The structure has generated very satisfactory commercial interest for servicing relatively small vehicles.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. An elevating structure for servicing relatively small vehicles, having in combination a base frame substantially rectangular in plan, a pair of transversely spaced upstanding frame members adjacent one end of said base frame, a cross member removably carried by said upstanding frame members, said cross member carrying a winch, longitudinally spaced transversely disposed pairs of elevating members pivoted to said base frame at their lower ends, a pair of longitudinal transversely spaced supporting frame members pivotally carried by said last mentioned elevating members, a shaft extending transversely of said last mentioned longitudinal members at their end portions adjacent said cross member, said winch having a cable removably connected to said shaft, a pair of longitudinally spaced plate members carried by said pair of longitudinal members, said cross member carrying a pair of hook members, said longitudinal members carrying a pair of recessed keepers at their respective ends adjacent said cross member to be engaged automatically by said hook members when said longitudinal members are drawn by said cable into abutting engagement with said cross member, a crank member carried by said cross member disengaging said hook members, and bolts extending through aligned holes of the pair of elevating frame members adjacent the pair of upstanding frame members.

2. The structure set forth in claim 1, wherein said elevating members have a plurality of longitudinally spaced holes therethrough transversely of said frame, said support frame members have holes therethrough adapted to be aligned with corresponding transverse pairs of holes through corresponding pairs of said elevating members, and bolts disposed through aligned pairs of said holes secure said cross members to said elevating members at a plurality of heights of said elevating members.

* * * * *